US006406113B1

(12) United States Patent
Kato

(10) Patent No.: US 6,406,113 B1
(45) Date of Patent: Jun. 18, 2002

(54) CONTROL METHOD FOR INK JET RECORDING APPARATUS AND INK JET RECORDING APPARATUS

(75) Inventor: Masao Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/069,747

(22) Filed: Apr. 30, 1998

(30) Foreign Application Priority Data

May 7, 1997 (JP) ..... 9-116855

(51) Int. Cl.[7] ..... B41S 2/01
(52) U.S. Cl. ..... 347/14; 347/18
(58) Field of Search ..... 347/9, 14, 17, 347/19, 18

(56) References Cited

U.S. PATENT DOCUMENTS 4,910,528 A 3/1990 Firl et al. ..... 346/1.1
5,646,655 A * 7/1997 Iwasaki et al. ..... 347/17
5,980,013 A * 11/1999 Takahashi ..... 347/14
5,986,684 A * 11/1999 Ohashi ..... 347/194
6,067,100 A * 5/2000 Otsuka et al. ..... 347/17

FOREIGN PATENT DOCUMENTS

| | | |
|---|---|---|
| EP | 0 396 343 | 11/1990 |
| EP | 0 605 207 | 7/1994 |
| EP | 0 678 385 | 10/1995 |
| EP | 0 694 394 | 1/1996 |
| EP | 0 795 405 | 9/1997 |
| JP | 3-4394 | 1/1991 |

* cited by examiner

*Primary Examiner*—Craig A. Hallacher
(74) *Attorney, Agent, or Firm*—Fitzpatrick, Cella, Harper & Scinto

(57) ABSTRACT

In a control method for an ink jet recording apparatus with which an amount of head generated by the head is restricted when a condition of a head temperature being not lower than a predetermined threshold is found includes the steps of detecting the head temperature and an environment temperature around the head, and restricting an extent of the amount of head generated by the head depending on the environment temperature or a difference between the head temperature and the environment temperature.

36 Claims, 18 Drawing Sheets

FIG. 3

| ENVIRONMENT TEMPERATURE Tr | INTERRUPT TIME to |
|---|---|
| ~Tr1 | t1 |
| ~Tr2 | t2 |
| ⋮ | ⋮ |
| ~Trn | tn |
| ⋮ | ⋮ |

FIG. 5

| ENVIRONMENT TEMPERATURE / HEAD TEMPERATURE DIFFERENCE ΔT | INTERRUPT TIME to |
|---|---|
| ~ΔT1 | t1 |
| ~ΔT2 | t2 |
| ⋮ | ⋮ |
| ~ΔTn | tn |
| ⋮ | ⋮ |

FIG. 7

| ENVIRONMENT TEMPERATURE Tr | MAXIMUM USABLE NOZZLE NUMBER n |
|---|---|
| ~Tr1 | n1 |
| ~Tr2 | n2 |
| ⋮ | ⋮ |
| ~Trn | nn |
| ⋮ | ⋮ |

[NORMAL MULTI-PASS PRINTING]

<FIRST SCAN>

<SECOND SCAN>

<THIRD SCAN>

[MULTI-PASS PRINTING UPON DETECTION OF ThTO (RESTRICTED IN NUMBER OF USABLE NOZZLES]
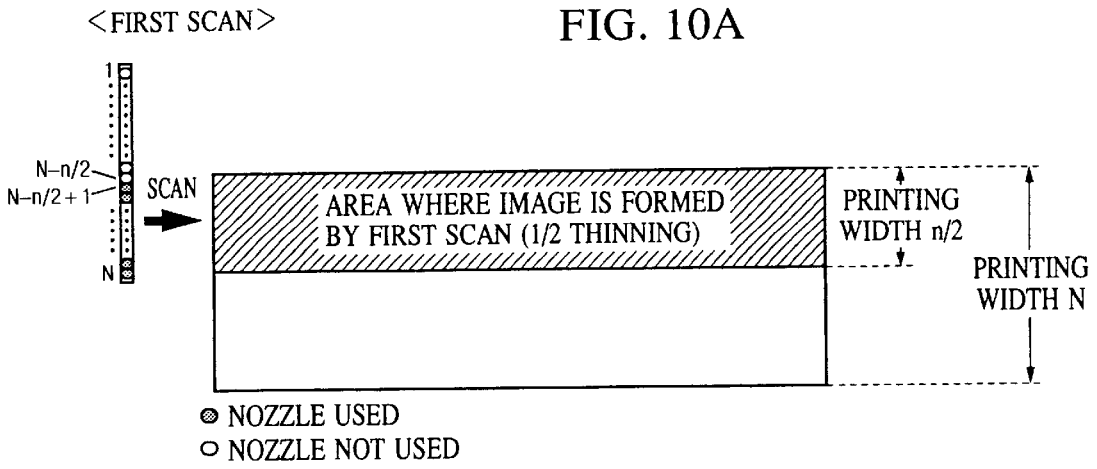
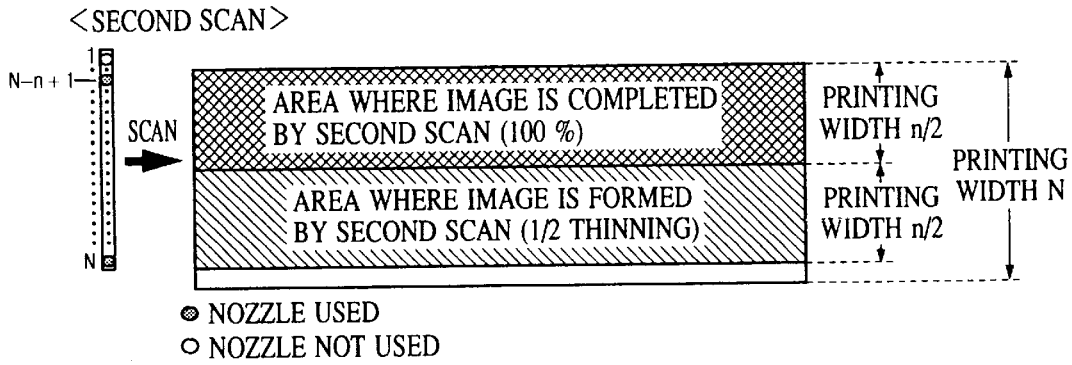

[MULTI-PASS PRINTING UPON DETECTION OF ThTO (RESTRICTED IN NUMBER OF USABLE NOZZLES)]

FIG. 12

| ENVIRONMENT TEMPERATURE / HEAD TEMPERATURE DIFFERENCE ΔT | MAXIMUM USABLE NOZZLE NUMBER n |
|---|---|
| ~ΔT1 | n1 |
| ~ΔT2 | n2 |
| ⋮ | ⋮ |
| ~ΔTn | nn |
| ⋮ | ⋮ |

FIG. 14

| ENVIRONMENT TEMPERATURE Tr | PRINTING DUTY THRESHOLD Dth |
|---|---|
| ~Tr1 | D1 |
| ~Tr2 | D2 |
| ⋮ | ⋮ |
| ~Trn | Dn |
| ⋮ | ⋮ |

CONTROL METHOD FOR INK JET RECORDING APPARATUS AND INK JET RECORDING APPARATUS

BACKGROUND OF THE INVENTION

1. Field of the Invention

The present invention relates to an ink jet recording apparatus capable of producing a high-quality image on a recording medium on which the image is to be recorded, and more particularly to an ink jet recording apparatus in which recording ink and an image quality improving agent for making insoluble or coagulating colorants mixed in the recording ink are ejected onto a recording medium.

2. Description of the Related Art

The present invention is applicable to all types of equipment for recording an image on recording media such as made of paper, cloth, leather, OHP and metal, for example, by utilizing thermal energy. Practical equipment adapted for application of the present invention include business machines, e.g., printers, copying machines and facsimiles, as well as industrial production machines.

An ink jet recording method has been hitherto used in printers and copying machines, for example, because of such advantages as low noise, low running cost, easiness in reducing the apparatus size, and easiness in printing an image in colors.

In an ink jet recording apparatus, ink is ejected from a nozzle to deposit on a sheet of recording paper, thereby forming an image. To improve a recording speed, a recording element and an ink ejection port and passage (nozzle) necessary for ejecting the ink are integrated and arrayed in plural number on a recording head (referred to as a multi-head hereinafter). An apparatus adapted for color recording includes a plurality of multi-heads.

FIG. 15 is a schematic perspective view of such an ink jet recording apparatus. A recording medium 106 inserted in a paper feed position of a recording apparatus 100 is advanced by a feed roller 109 to a recording enable area covered by a recording head unit 103. A platen 108 is provided to support a lower surface of the recording medium in the recording enable area. A carriage 101 is constructed to be movable in a direction determined by two guide shafts, i.e., a guide shaft 104 and a guide shaft 105, to reciprocally scan the recording enable area. On the carriage 101, there is mounted a recording head unit 103 comprised of recording heads for ejecting inks in plural colors and ink tanks for supplying the inks in plural colors to the recording heads, respectively. The illustrated ink jet recording apparatus employs inks in four colors, i.e., black (Bk), cyan (C), magenta (M) and yellow (Y). A restoration system unit 110 is provided in a lower portion at the left end of an area within which the carriage 101 is movable, enabling the ejection ports of the recording head to be capped while the apparatus is in a not-recording mode. That left end is called a home position of the recording head.

Reference numeral 107 denotes a switch portion and a display device portion. The switch portion is used, for example, when turning on/off a power supply of the recording apparatus and setting any of various recording modes. The display device portion indicates a state of the recording apparatus.

FIG. 16 is a perspective view of the recording head unit 103. In the illustrated unit, ink tanks 20A to 20C corresponding to respective color inks in black, cyan, magenta and yellow are replaceable independently of each other.

The carriage 101 mounts thereon a recording head 102 provided with a plurality of ejection ports for ejecting the inks in Bk, C, M and Y through them and a plurality of flow passages (nozzles) connected to the ink ejection ports, respectively, and four ink tanks, i.e., a Bk ink tank 20K, a C ink tank 20C, an M ink tank 20M and a Y ink tank 20Y. The ink tanks are connected to the recording head through connecting portions for supplying the inks to the nozzles from the tanks, respectively.

In addition to the above structure, there are also known recording head units in which, by way of example, tanks for inks in four color are integral with each other, or tanks for inks in C, M and Y are integral with each other, but independent of a tank for Bk ink.

FIG. 17 is a schema tic enlarged sectional view of a he at generating member and thereabout in the recording head. A heat generating member 30 comprising an electro-thermal transducer is arranged corresponding to an ink ejection port 23 in one-to-one relation. In a recording apparatus mounting thereon an,ink jet recording head thus constructed, an image is recorded by applying a drive signal to the heat gene rating member 30 of the head in accordance with recording information and ejecting ink from a nozzle. The heat generating member 30 can be drive n in an independent manner for each of all the nozzles. When the ink in the nozzle is quickly heated by energization of the heat generating member, a bubble is created in the ink due to film boiling and an ink droplet 35 is ejected toward a recording medium 31 under pressure developed upon the creation of the bubble, as shown in FIG. 17, thereby forming an image comprising characters or a picture on the recording medium. At this time, the volume of the ink droplet for each color ejected in such away is on the order of 15–100 ng.

The recording head has a plurality of ejection ports 23, a plurality of ink flow passages (nozzles) connected respectively to the ejection ports 23, and a common liquid chamber 32 formed rearward of a portion where the ink flow passages are disposed (i.e., on the upstream side) for supplying the ink to the ink flow passages. In each of the ink flow passages corresponding to the ejection ports in one-to-one relation, there are provided the heat generating member 30 for generating thermal energy used to eject an ink droplet from the ejection port, and an electrode wiring (not shown) for supplying electric power to the heat generating member 30. The heat generating member 30 and the electrode wiring are formed on a device board 33 made of, e.g., silicon by the semiconductor film deposition technique. A protective film 36 is formed on the heat generating member 30 to prevent the ink from coming into direct contact with the heat generating member 30. A partition wall 34 made of resin, glass or any other suitable material is placed on the device board to define the ejection ports, the ink flow passages, the common liquid chamber, etc. therebetween.

Such a recording system using the heat generating member is called a bubble jet recording system because a bubble created upon application of thermal energy is used to eject the ink droplet.

FIG. 18 is a typical block diagram for driving the recording head in the ink jet recording apparatus stated above.

Data of an image comprising characters or a picture to be recorded (referred to image data hereinafter) is input from a host computer to a reception buffer 401 in the recording apparatus 100. Also, data for confirming whether the data is transferred correctly or not and data for informing an operating condition of the recording apparatus are output from the recording apparatus to the host computer. The data in the reception buffer 401 is transferred to a memory unit 403 and temporarily stored in a RAM (Random Access Memory) under surveillance of a CPU (control unit) 402.

A mechanism controller 404 drives a mechanism portion 405, including a carriage motor, a line feed motor and so forth, in accordance with a command from the CPU 402. A sensor/SW controller 406 is a control unit for sending signals from a sensor/SW portion 407, including various sensors and SW's (switches), to the CPU 402. A display device controller 408 is a control unit for controlling a display device portion 409, including LED's, a liquid crystal display device and so forth on a display panel, in accordance with a command from the CPU 402. A recording head controller 410 controls a recording head 411 in accordance with a command from the CPU 402. The recording head controller 410 serves also as a control unit for sensing temperature and other information indicating a condition of the recording head 411 and transmitting the information to the CPU 402.

In such an ink jet recording apparatus utilizing thermal energy (called also a thermal ink jet printer), techniques for increasing a printing speed of the ink jet printer have been developed. The printing speed has been increased by, e.g., increasing the number of nozzles provided in one head or rasing the driving frequency.

An important point to be taken into consideration in the thermal ink jet printer is an excessive temperature rise of the recording head. In the thermal ink jet printer, the energy applied to the heat generating member in the head is not all consumed as energy required for ejection of the ink droplet and a large part of the applied energy remains as heat in the head. For that reason, when the thermal ink jet printer is constructed as mentioned above aiming an increase in printing speed, the amount of heat remaining in the head is further increased.

If a temperature rise of the head or ink is left as it is and not controlled in the thermal ink jet printer, this would not only make unstable an ejecting condition of the ink droplet, but also disable proper ejection of the ink droplet due to a resulting excessive temperature rise. In the worst case, there is a risk that the head may break down physically because of too much heat accumulated in it.

With the above problem in mind, several methods for preventing an excessive temperature rise of the head have been hitherto incorporated in driving/printing control of the thermal ink jet printer. There are proposed, for example, a method of detecting a head temperature and interrupting the recording for a predetermined time when the detected temperature is not lower than a predetermined value, and a method (Japanese Patent Publication No. 03-4394) of detecting a head temperature during the recording of one line, interrupting the recording after the end of the recording of that line when the detected temperature reaches a first prescribed value (i.e., when the head temperature rises excessively), and resuming the recording when the head temperature is lowered down below a second prescribed value.

There are also known methods for preventing an excessive temperature rise based on other parameters than the head temperature. One of those known methods is, for example, to make control based on both a detected result of the head temperature and a predicted result of the amount of temperature rise obtained by previously reading the recording duty of data to be recorded next (U.S. Pat. No. 4,910,528).

However, a rate of temperature rise or drop is not always constant because it greatly depends on the environment temperature around the head and the head temperature at that time. Accordingly, the above-stated method of interrupting the recording when the head temperature exceeds a threshold has had a problem that the interrupt time must be set to be longer than the least necessary time for ensuring safety and the recording speed may be eventually reduced as a whole. On the other hand, the method of previously reading the recording duty and predicting an amount of temperature rise has had a problem that if a prediction parameter is set in anticipation of the amount of temperature rise under high-temperature environment, this may result in overmuch control with a relatively large allowance under normal-temperature environment and also eventually reduce the printing speed in fact.

Further, when temperature control is performed in the above-mentioned thermal ink jet printer by using a result detected by a temperature sensor provided on the device board in the recording head, there is a difficulty in using an output value of the temperature sensor directly as the head temperature because individual temperature sensors have substantial errors in themselves due to variations in manufacture process. That problem can be overcome to some extent by suppressing variations in manufacture process of temperature sensors, but severer process control would, push up a head cost. In many cases, therefore, the output value of the temperature sensor is corrected and the corrected value is used in temperature control of the thermal ink jet printer. The correction of the sensor output value is however so complex that some error is mixed in the detected value even after the correction when conditions set for the correction are not optimum, and the purpose of control to be performed upon detection of an excessive temperature rise cannot be often fulfilled satisfactorily.

SUMMARY OF THE INVENTION

With the view of solving the problems as set forth above, an object of the present invention is to control a head temperature rise in a thermal ink jet printer during recording in a stabler manner, stabilize ink ejection, avoid failure of ink ejection, and to prevent thermal damage of an ink jet head.

To achieve the above object, the present invention provides a control method for an ink jet recording apparatus with which an amount of heat generated by an ink jet head is restricted when a condition of a head temperature being not lower than a predetermined threshold is found by the use of means for detecting the head temperature and an environment temperature around the head, wherein an extent of restricting the amount of heat generated by the head is changed depending on the environment temperature or a difference between the head temperature and the environment temperature. The present invention also provides an ink jet recording apparatus comprising means for detecting a temperature of an ink jet head, means for detecting an environment temperature around the head, means for restricting an amount of heat generated by the head when a condition of the head temperature being not lower than a predetermined threshold is found, and control means for changing an extent of restricting the amount of heat generated by the head depending on the environment temperature or a difference between the head temperature and the environment temperature.

With the above features, an excessive temperature rise of the ink jet head is prevented; hence failure of ink ejection and damage of the head can be avoided. In addition, since a standby time, extra split printing and so on which have been hitherto incorporated in the control process more than required are eliminated, the efficiency of recording is improved and higher-speed recording can be achieved as a whole.

BRIEF DESCRIPTION OF THE DRAWINGS

FIG. 3 is a table in which an interrupt time t is defined with respect to an environment temperature Tr.

FIG. 5 is a table in which an optimum interrupt time t is defined beforehand with respect to ΔT.

FIG. 7 is a table in which the maximum number n of usable nozzles is defined with respect to the environment temperature Tr.

FIGS. 10A–D are schematic views for explaining multi-pass printing according to the third embodiment of the present invention.

FIG. 12 is a table in which the maximum number n of usable nozzles is defined with respect to ΔT.

FIG. 14 is a table in which a printing duty threshold is defined with respect to the environment temperature Tr.

DETAILED DESCRIPTION OF THE PREFERRED EMBODIMENTS

Several embodiments of the present invention will be described hereunder with reference to the drawings. Note that the configuration of an ink jet recording apparatus (thermal ink jet printer), the structure of a head and the block diagram of driving the head, explained above, are also applicable to the present invention except those portions specific to the present invention and hence are not explained here.

(First Embodiment)

A first embodiment of the present invention will be described in detail with reference to FIGS. 1 to 3.

Figure 1:
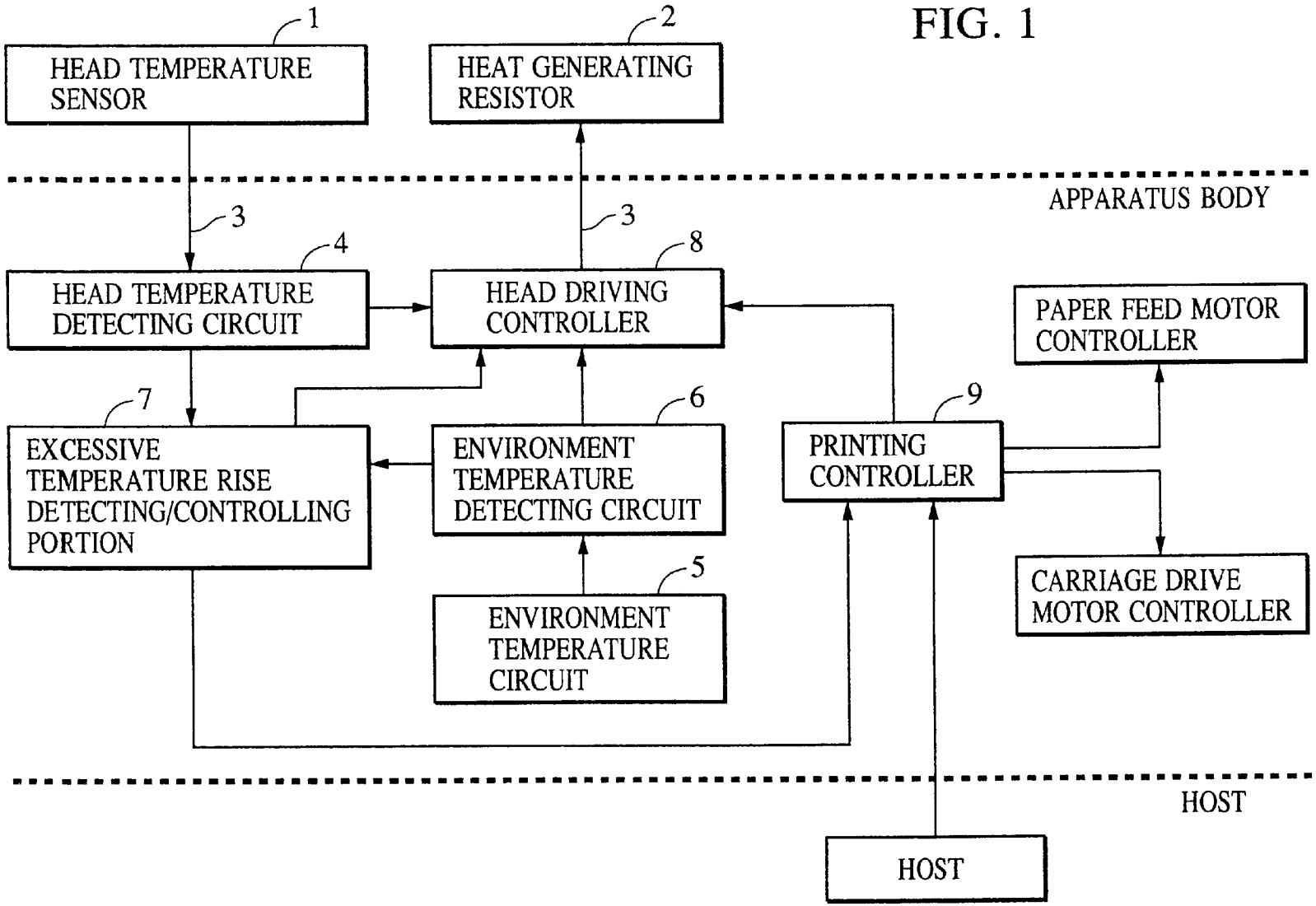
FIG. 1 is a control block diagram according to the present invention for detecting a head temperature and an environment temperature around a head and controlling the head temperature.
Figure 2:
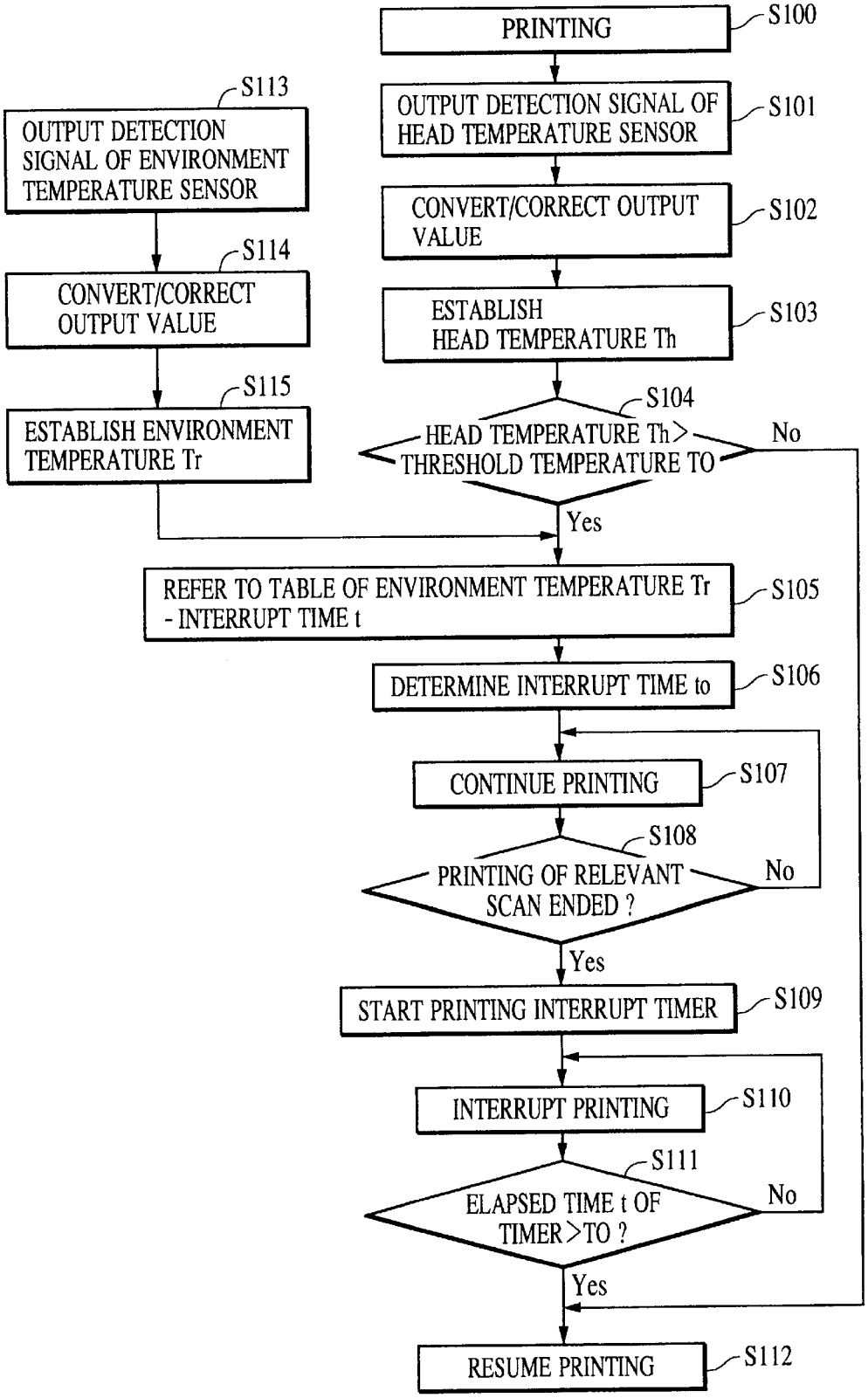
FIG. 2 is a flowchart for explaining a temperature control process in the present invention.

FIG. 1 is a control block diagram according to the present invention for detecting a head temperature and an environment temperature around a thermal ink jet head and controlling the head temperature. Disposed within the thermal ink jet head is a heater board (device board) in the form of a Si substrate on which are integrated a heat generating member for ejecting ink along with an electric circuit and a drive device for controlling and driving the heat generating member. In FIG. 1, denoted by 1 is a head temperature sensor on the heater board. While this embodiment uses a diode as the head temperature sensor and detects the head temperature by utilizing the temperature characteristic of an output voltage of the diode, the head temperature may be detected by any other suitable way, for example, utilizing the temperature characteristic of a resistance value of an electric resistor. Denoted by 2 is a heat generating member for ejecting a recording ink droplet, and 3 is a signal line (flexible wiring) for transmitting signals between the head and an apparatus body.

Denoted by 4 is a head temperature detecting circuit made up of a circuit for detecting an output signal from the head temperature sensor, an A/D-converter circuit for converting the detected signal into digital data, a conversion/correction circuit for modifying an A/D-converted value into temperature data in the form suitable for subsequent control processes, etc. An output result of the head temperature detecting circuit is handled as the head temperature and used to carry out various types of control such as PWM (Pulse Width Modulation) control of a head driving pulse.

Denoted by 5 is a head environment temperature sensor comprising a thermistor or the like provided on a board, which is disposed on a carriage mounting the head thereon, for detecting the environment temperature around the head (ink). 6 is an environment temperature detecting circuit made up of, similarly to the head temperature detecting circuit 5, a circuit for detecting an output of the thermistor, an A/D-converter circuit, a conversion/-correction circuit, etc. An output result of the environment temperature detecting circuit is handled as the environment temperature.

Denoted by 7 is an excessive temperature rise detecting/controlling portion in which whether to perform a head temperature rise preventing sequence or not is determined based on both the head temperature detected result from the head temperature detecting circuit 4 and the environment temperature detected result from the environment temperature detecting circuit 6. The head temperature rise preventing sequence is a sequence for preventing instability or failure of ink ejection and damage or breakdown of the head. There are known several types of temperature rise preventing sequences such as interrupting the printing for a while, carrying out split printing, and lowering the driving frequency. Here, any suitable one of those sequences may be used.

Note that although conditions in combining the head temperature and the environment temperature to provide criteria for determining whether the temperature rise preventing sequence is to be started or not will be described later, the following description will be made of one or both of a condition for starting the temperature rise preventing sequence and a condition for ending it.

Denoted by 8 is a head driving controller for, e.g., determining a condition to drive the heat generating resistor in the print head, generating a drive signal and driving/controlling a head temperature holding heater (not shown) based on a detected value of the head temperature from the head temperature detecting circuit 4, information from a printing controller 9, and so on.

Denoted by 9 is a printing controller with functions of, e.g., determining which ones of nozzles are actually driven at which timings to eject ink droplets based on print data supplied from a host and a printing condition such as a printing mode set by a user through a control panel or the like, and correspondingly determining the timing and amount at and by which a drive motor for driving the carriage and a paper feed motor are each to be driven.

A temperature control process executed in the printer of this embodiment will be explaining below with reference to FIG. 2. During the printing operation, a detection signal is output from the head temperature sensor 1 (S101) at all times and then converted and corrected by the head temperature detecting circuit 4 in the apparatus body (S102), followed by establishing a head temperature Th (S103). The head temperature Th is sent to the excessive temperature rise detecting/controlling portion 7.

Likewise, a detection signal is output from the environment temperature sensor 5 (S113) and then converted and corrected by the environment temperature detecting circuit 6 (S114), followed by establishing an environment temperature Tr (S115). The environment temperature Tr is also sent to the excessive temperature rise detecting/-controlling portion 7.

The excessive temperature rise detecting/controlling portion 7 compares the head temperature Th with a threshold temperature T0 that is a reference temperature for determining whether to perform the head temperature rise preventing sequence or not (S104). If T0<Th is detected, then a predetermined signal is sent to both the printing controller 9 and the head driving controller 8. Upon receiving the signal, the printing controller 9 and the head driving controller 8 allow continued printing of the print data just for the current scan (line) under the printing (S107, S108) and then interrupt printing of the next scan (S110) after the printing of the relevant scan has been ended.

Also, as soon as T0<Th is detected, reference is made (S105) to a table in which an interrupt time t is defined with respect to the environment temperature Tr, as shown in FIG. 3, thereby determining an interrupt time t0 (S106). On the other hand, at the same time as printing interrupt begins, the excessive temperature rise detecting/controlling portion 7 makes a rest time timer for measuring an interrupt time start to count up the interrupt time t (S109). If the interrupt time t elapses to meet t>t0 (S111), then a printing resume command is sent to both the printing controller 9 and the head driving controller 8 to resume the printing (S112).

A manner of setting the interrupt time in the temperature control process of this embodiment will be described below. When the recording head heated to a high temperature is left to stand as it is after stopping the recording, an amount of temperature drop of the recording head greatly depends on the temperature Th of the recording head, a difference (ΔT=Th−Tr) between the head temperature Th and the environment temperature Tr around the head, and the elapsed time. Because the temperature at which the recording head causes failure of ink ejection or the temperature at which the recording head is thermally damaged can be determined as an absolute temperature, the aforesaid threshold temperature T0 can be set to a substantially constant value. A temperature drop characteristic of the head therefore greatly depends on the environment temperature Tr such that the head temperature quickly lowers when the environment temperature Tr is low, and it slowly lowers when the environment temperature Tr is high. Thus the printing interrupt time t0 is required to be long when the environment temperature Tr is high, but can be shortened when the environment temperature Tr is low.

In this embodiment, the interrupt time is set in accordance with a table in which each optimum interrupt time t0 is defined beforehand with respect to the environment temperature Tr, as shown in FIG. 3. The table of FIG. 3 contains the relationships of Tr1<Tr2< . . . <Trn< . . . and t1<t2< . . . <tn<. . . ; that is, the higher the environment temperature Tr, the longer is the interrupt time t0.

By setting the interrupt time t0 in such a manner, it is possible to prevent drawbacks which have been hitherto caused in the case of setting the interrupt time to a constant value regardless of the environment temperature, i.e., instability of the printing under high-temperature environment and too long interrupt of the printing under low-temperature environment. As a result, stable printing can be achieved under various environments while avoiding reduction in printing speed as far as practicable.

While this embodiment has been described as, after detecting an excessive temperature rise, completing the printing of the relevant scan and then interrupting the printing (stopping the next scan), the control may be performed by stopping heating of the ejection heater of the head even during the printing at the same time as detection of Th>T0 and resuming the printing of remained data in the same scan after a predetermined time, or by interrupting heating during the printing similarly and resuming the printing after performing idle scan for a predetermined time. Such a modified case can also provide similar advantages by setting the interrupt time depending on the environment temperature Tr in a like manner as in the above embodiment.

(Second Embodiment)

In the above first embodiment, the interrupt time is selected based on the environment temperature Tr, but in this second embodiment the interrupt time is set in consideration of not only the environment temperature Tr but also the head temperature.

Figure 4:
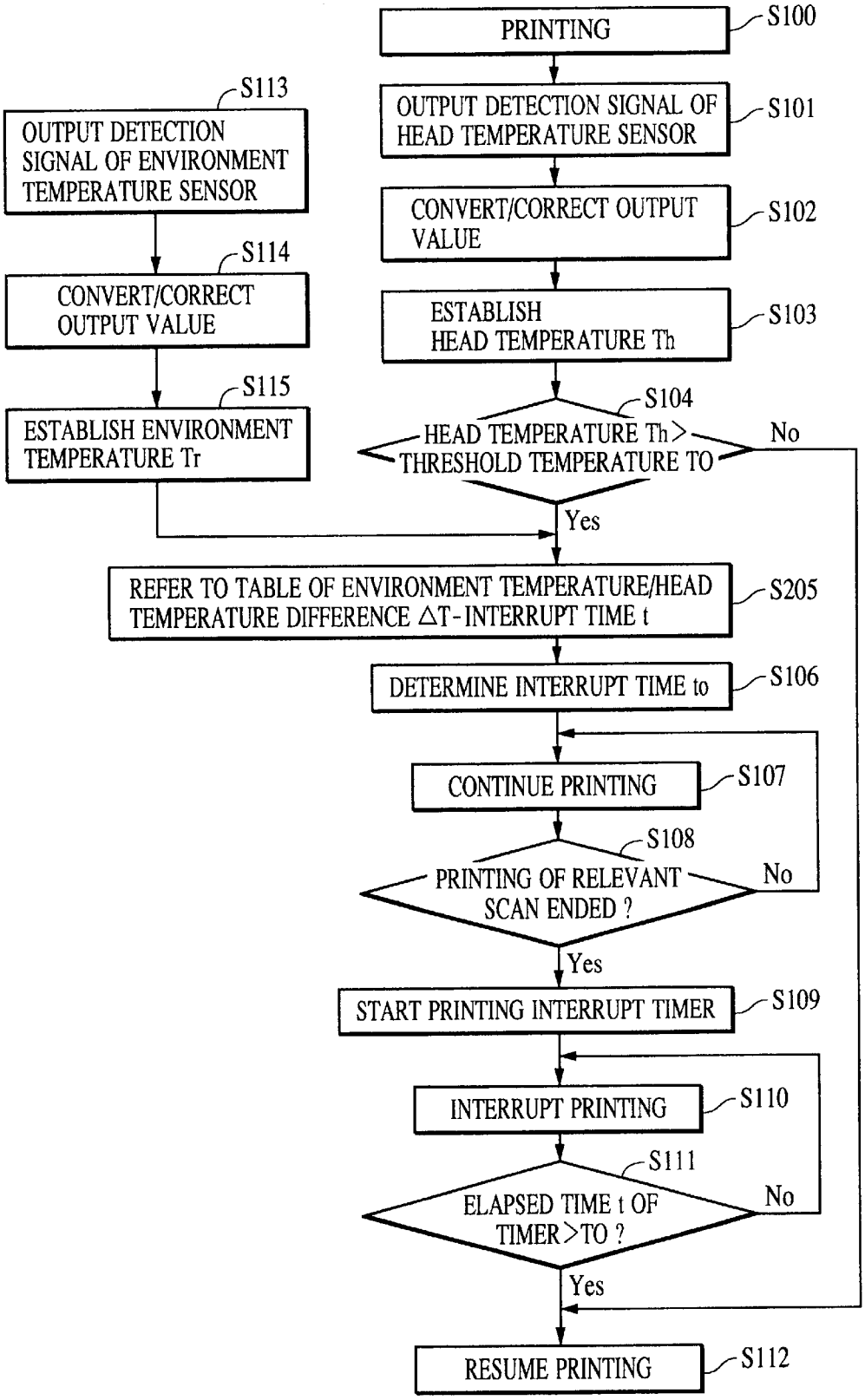
FIG. 4 is a flowchart for explaining a temperature control process in the present invention.

Note that the control block diagram used in this embodiment also has the same construction as shown in FIG. 1. FIG. 4 shows a temperature control process executed in the printer of this embodiment. The temperature control process in this embodiment is the same as in the first embodiment except only the step of referring to the interrupt time t0.

In the above first embodiment, the interrupt time t0 is determined based on the environment temperature Tr. On the other hand, this embodiment determines the interrupt time t0 based on a difference ΔT between the temperature Th of the recording head and the environment temperature Tr around the head so that the interrupt time t0 is more appropriately determined. As stated above in connection with the first embodiment, an amount of temperature drop of the recording head greatly depends on the temperature Th of the recording head, the difference (ΔT=Th−Tr) between the head temperature Th and the environment temperature Tr around the head, and the elapsed time. The head temperature quicky lowers when ΔT is large, and it slowly lowers when ΔT is small. Thus the printing interrupt time t0 can be shortened when ΔT is large, but can be long when ΔT is small. In this embodiment, the interrupt time is set in step S205 of FIG. 4 in accordance with a table in which each optimum interrupt time t0 is defined beforehand with respect to ΔT, as shown in FIG. 5.

The table of FIG. 5 contains the relationships of ΔT1<ΔT2< . . . <ΔTn< . . . and t1>t2> . . . >tn> . . . ; that is, the larger ΔT, the longer is the optimum interrupt time t0.

Consequently, with this embodiment, since the table defining the relationship between ΔT and the interrupt time is used, the appropriate interrupt time can be set with better accuracy.

(Third Embodiment)

This third embodiment differs from the above second and third embodiments in process of controlling the printer operation after detecting an excessive temperature rise, i.e., a condition where the head temperature is higher than the threshold temperature. Note that the control block diagram used in this embodiment also has the same construction as in the above embodiments (FIG. 1).

Figure 6:
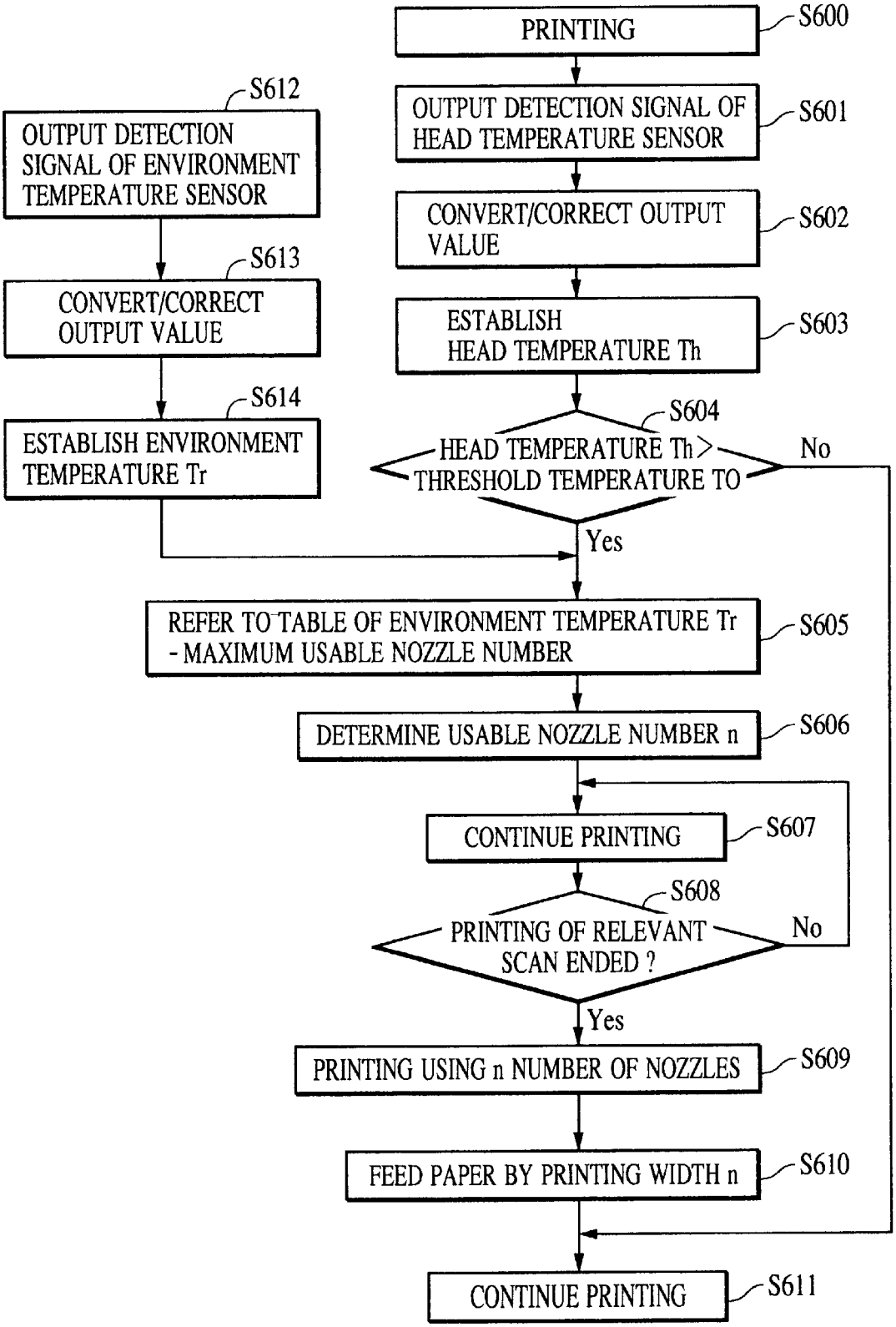
FIG. 6 is a flowchart for explaining a temperature control process in the present invention.

A temperature control process executed in this embodiment will be described below with reference to FIG. 6.

Similarly to the first embodiment, during the printing operation, a detection signal is output from the head temperature sensor 1 (S601) at all times and then converted and corrected by the head temperature detecting circuit 4 in the apparatus body (S602), followed by establishing a head temperature Th (S603). The head temperature Th is sent to the excessive temperature rise detecting/controlling portion 7.

Likewise, a detection signal is output from the environment temperature sensor 5 (S612) and then converted and corrected by the environment temperature detecting circuit 6 (S613), followed by establishing an environment temperature Tr (S614). The environment temperature Tr is also sent to the excessive temperature rise detecting/-controlling portion 7.

The excessive temperature rise detecting/controlling portion 7 compares the head temperature Th with a threshold temperature T0 that is a reference temperature for determining whether to perform the head temperature rise preventing sequence or not (S604). If T0<Th is detected, then a predetermined signal is sent to both the printing controller 9 and the head driving controller 8. Upon receiving the signal, the printing controller 9 and the head driving controller 8 allow continued printing of the print data just for the current scan (line) under the printing (S607, S608) and then perform printing of the next scan several times in a split manner. At this time, a maximum printing width n of the split printing (i.e., the maximum number n of usable nozzles) is determined (S606) by referring to a table defining the relationship between the maximum number n of usable nozzles and the environment temperature Tr (S606), as shown in FIG. 7.

Figure 8:
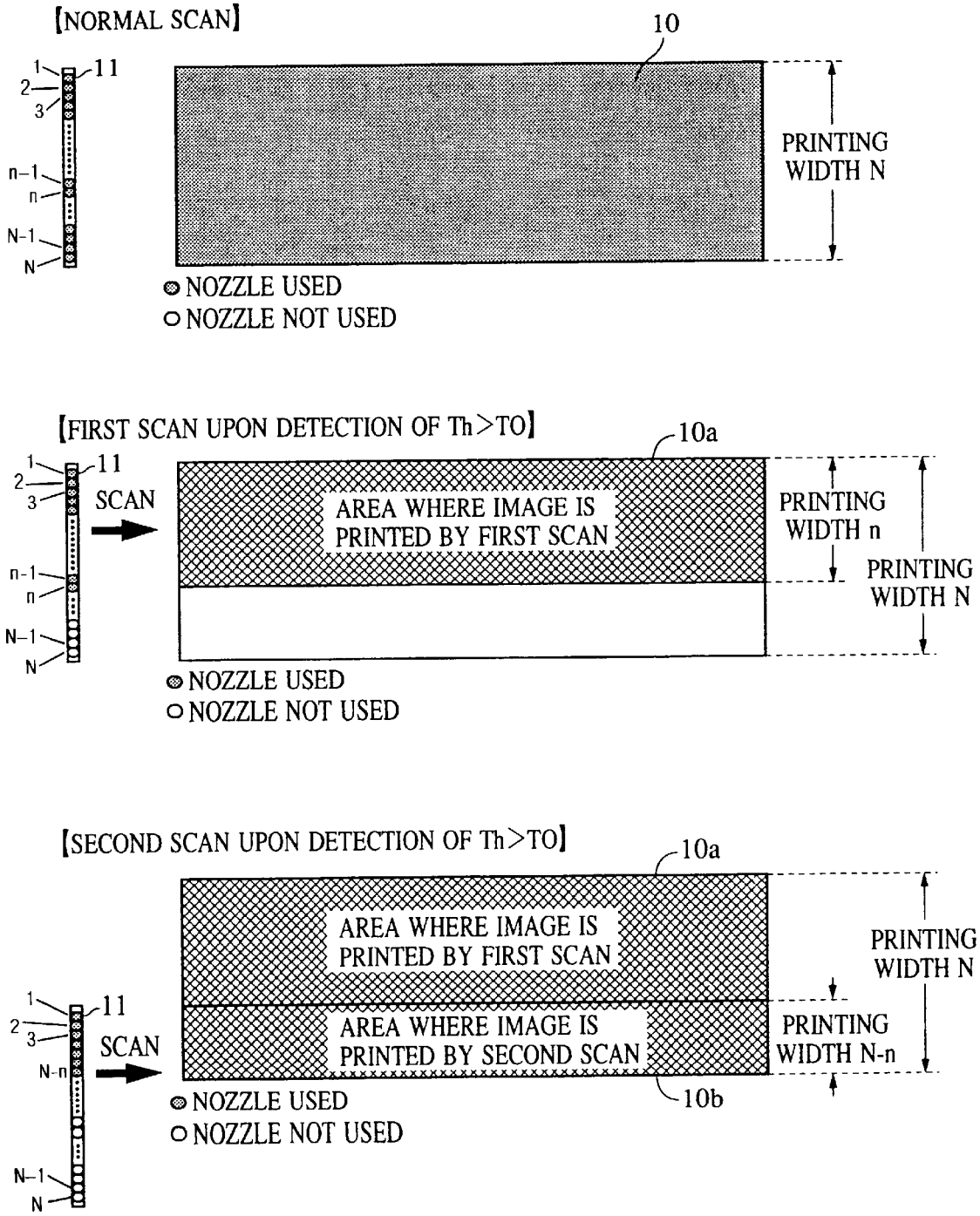
FIG. 8 is a schematic view for explaining a manner of performing split printing according to a third embodiment of the present invention.

FIG. 8 shows a manner of performing the split printing. An area 10 represents an image area covered by one scan having a normal printing width (nozzle number) N. In FIG. 8, the printing width corresponds to the total number of nozzles in the head 11. In fact, however, the printing width corresponds to the number of nozzles used for printing the print data of the relevant scan; hence it is not always required for the printing width N to be equal to a width covered by the total number of nozzles in the head 11. By a first scan after detecting the fact that the head temperature Th has exceeded the threshold temperature T0, an image is completely printed in a printing area 10*a* (S609) by using a number n of upper nozzles, as viewed on the drawing, of the total number N of nozzles in the head 11. After that, recording paper is fed by a distance corresponding to the printing width n (S610) and then an image is completely printed in a printing area 10*b* by a second scan (S610). On this occasion, the printing width of the printing area 10*b* is likewise set to a value n corresponding to the environment temperature Tr at that time if the relationship between the head temperature and the threshold temperature is still Th>T0.

A manner of dividing the printing area in the temperature control process of this embodiment will be described below.

A rate of temperature rise of the head under printing is greatly affected by the environment temperature Tr. When carrying out the printing under the same conditions except the environment temperature Tr, the rate of temperature rise is smaller at lower Tr, and is larger at higher Tr. In this embodiment, as listed in a table shown in FIG. 7, the maximum number of usable nozzles is restricted depending on the environment temperature Tr. The table of FIG. 7 contains the relationships of Tr1<Tr2< . . . <Trn< . . . and n1>n2 > . . . >nn> . . . ; that is, the maximum number of usable nozzles is smaller at the higher. environment temperature Tr, and is larger at the lower environment temperature Tr. This enables the printing to be performed using the maximum number of usable nozzles at each environment temperature. It is therefore possible to prevent too long interrupt of the printing which has been caused by the conventional split printing process not taking the environment temperature into consideration, and to achieve stable printing under various environments while avoiding reduction in printing speed as far as practicable.

While the above explanation is made in connection with one-pass recording, this embodiment can be similarly applied to multi-pass printing that is known as one of ink jet recording methods. Examples of multi-pass (two-pass) printing are shown in FIGS. 9 and 10.

Figure 9A:
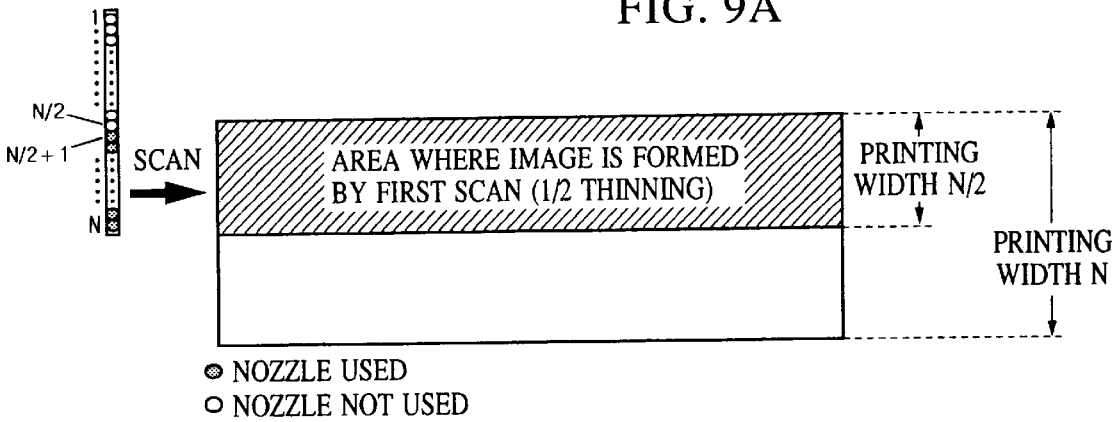
FIGS. 9A–C are schematic views for explaining multi-pass printing.
Figure 9B:
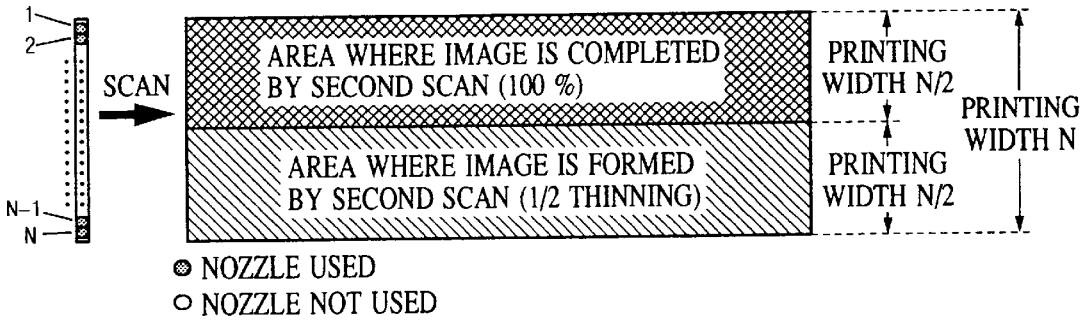
Figure 9C:
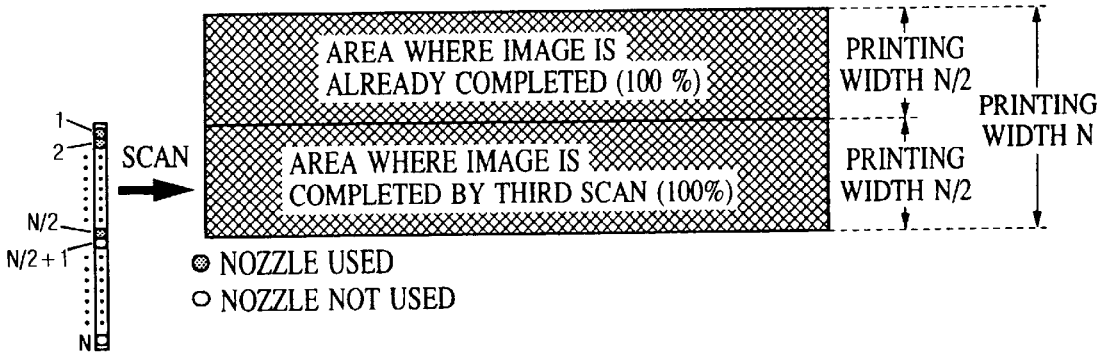
Figure 10C:
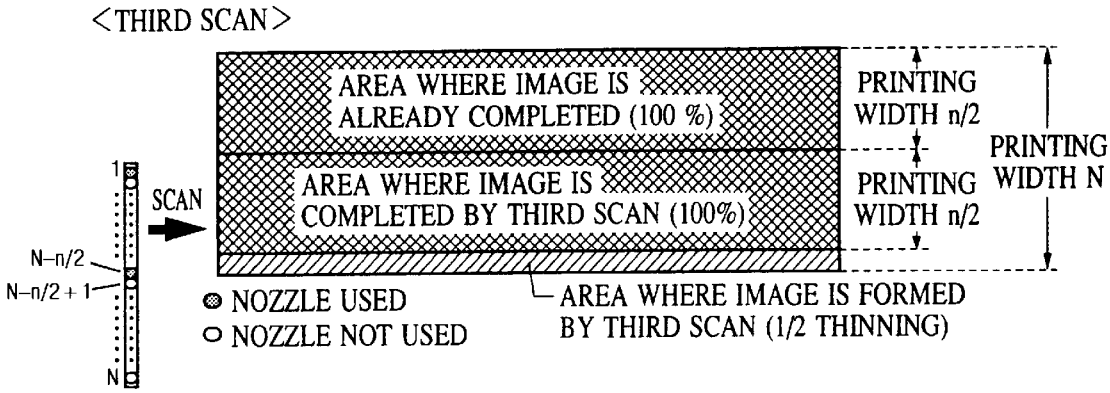
Figure 10D:
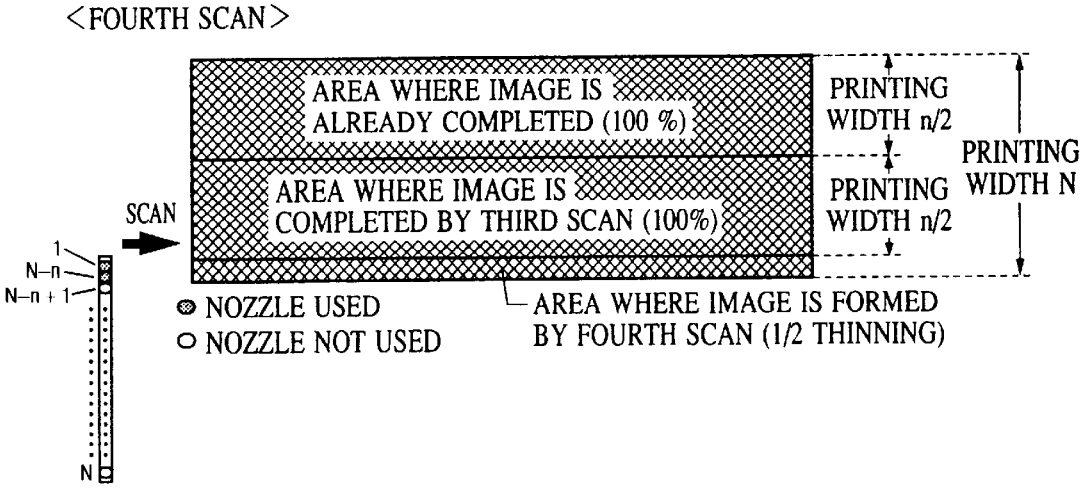

More specifically, FIG. 9 shows, for comparison, an example conventional (normal) multi-pass printing in which the split printing in consideration of both the environment temperature and the head temperature according to the present invention is not effected. The so-called multi-pass printing is to perform recording by dividing the total nozzle number N of the head into plural groups each including a predetermined number of nozzles. In the illustrated example, the total nozzle number N of the head is divided into two halves so that an image is completed in an area corresponding to the printing width N by three scans. By a first scan shown at A, an image is recorded in an area corresponding to the printing width N/2 using a number N/2 of nozzles in a lower half of the total number N of nozzles in the head while thinning out the number of printing dots to ½.

By a second scan shown at B, an image is recorded in an area corresponding to the printing width N using the total number N of nozzles in the head while thinning out the number of printing dots to ½. As a result of the second scan, in the area where the image has been partly recorded by the first scan, the image is completely or 100% recorded by another ½-thinned-out recording combined with the above ½-thinned-out recording in superposed relation.

Subsequently, by a third scan shown at C, an image is recorded in an area corresponding to the printing width N/2, where the image is not completely recorded, using a number N/2 of nozzles in an upper half of the total number N of nozzles in the head while thinning out the number of printing dots to ½.

In that case, since the number of nozzles is fixedly divided into N/2 not taking into account the environment temperature Tr, an excessive temperature rise may occur even with division of the number of nozzles into N/2.

On the other hand, in the example shown in FIG. 10, if the head temperature exceeds the threshold temperature, the maximum number of usable nozzles is restricted depending on the environment temperature and the split two-pass printing is realized by changing a manner of dividing the printing width N in accordance with the restricted maximum number of usable nozzles. More specifically, an image is recorded by a first scan using the number n/2 of nozzles, and then by a second scan using a number n of nozzles to complete the image in an area scanned by the first scan. After that, an image is recorded by a third scan using a number (N−n/2) of nozzles and then by a fourth scan using a number (N−n) of nozzles successively, thereby completing the image in an area corresponding to the printing width N. As a result, the recording speed can be increased while preventing an excessive temperature rise of the head.

(Fourth Embodiment)

Figure 11:
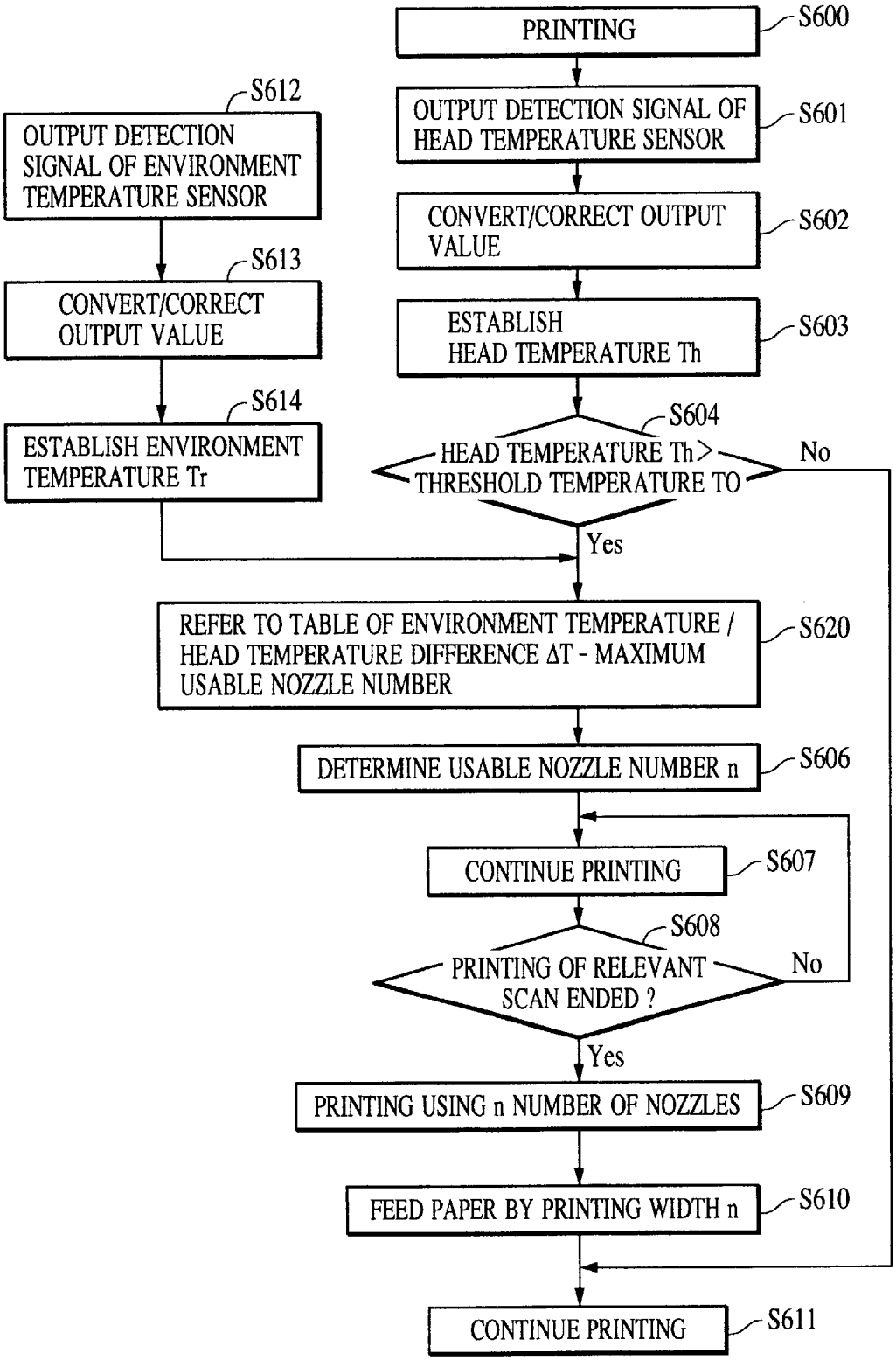
FIG. 11 is a flowchart for explaining a temperature control process in the present invention.

The maximum number of usable nozzles is determined in the above third embodiment based on the environment temperature Tr to perform the split printing, but this fourth embodiment utilizes not only the environment temperature Tr but also the difference ($\Delta T = Th - Tr$) between the temperature Th of the recording head and the environment temperature Tr around the head, as with the second embodiment, for controlling the split printing with better accuracy. FIG. 11 shows steps of a temperature control process executed in this embodiment, but the steps as those in FIG. 6 relating to the third embodiment and are not described here. A manner of determining the maximum number of usable nozzles in steps S620 and S606 will be explained below.

When carrying out the printing under the same conditions except $\Delta T$, the rate of temperature rise is smaller at larger $\Delta T$, and is larger at smaller $\Delta T$. In this embodiment, as listed in a table shown in FIG. 12, the maximum number of usable nozzles is restricted depending on $\Delta T$. The table of FIG. 12 contains the relationships of $\Delta T1 < \Delta T2 < \ldots < \Delta Tn < \ldots$ and $n1 < n2 < \ldots < nn < \ldots$, that is, the maximum number of usable nozzles is larger at the larger $\Delta T$, and is smaller at the smaller $\Delta T$. This enables the printing to be performed using the maximum number of usable nozzles at each $\Delta T$. It is therefore possible to prevent too long interrupt of the printing which has been caused by the conventional split printing process not taking the environment temperature into consideration, and to achieve stable printing under various environments while avoiding reduction in printing speed as far as practicable.

In addition, this embodiment wherein the maximum number of usable nozzles is determined depending on $\Delta T$ is also applicable to the multi-pass printing explained above in connection with the third embodiment.

(Fifth Embodiment)

Figure 13:
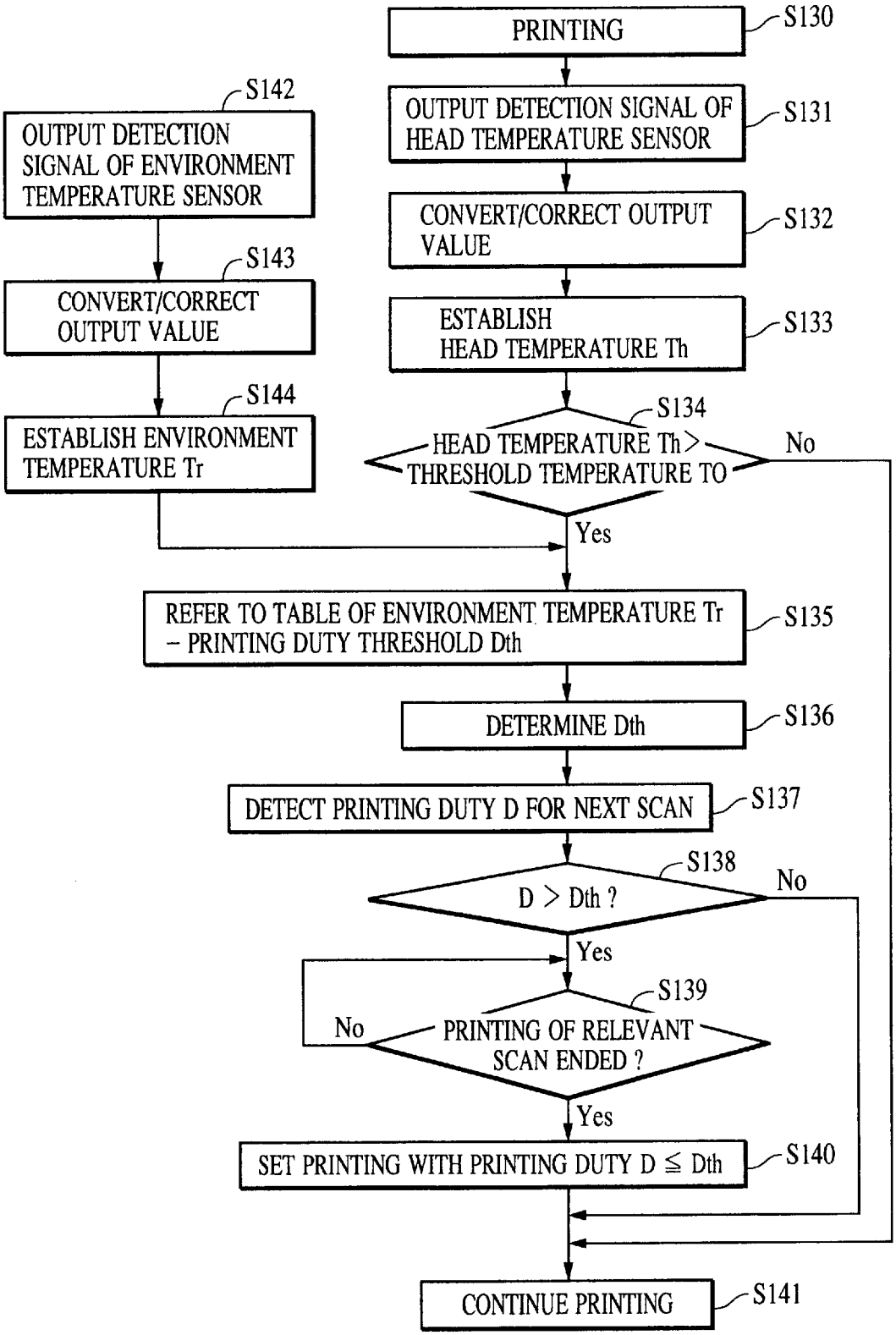
FIG. 13 is a flowchart for explaining a temperature control process in the present invention.
Figure 15:
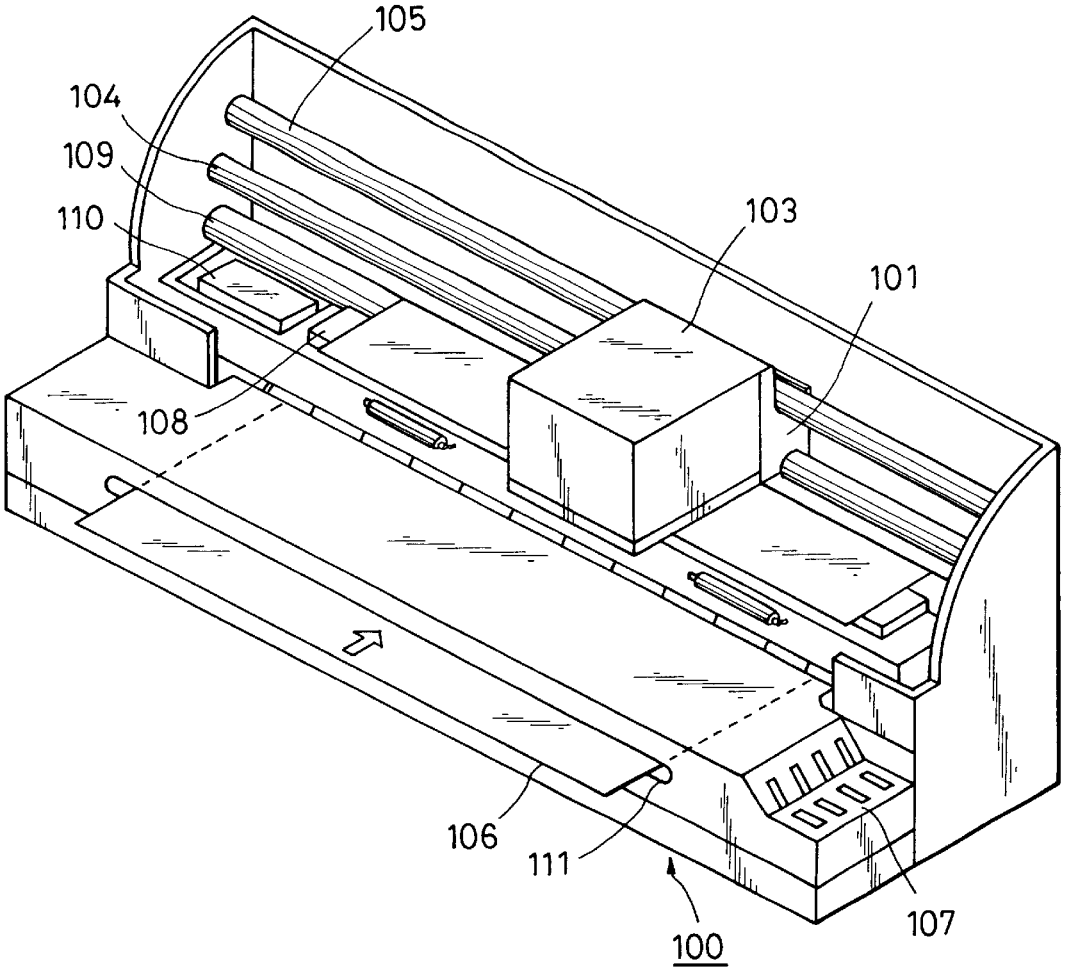
FIG. 15 is a schematic perspective view for explaining the construction of an ink jet recording apparatus.
Figure 16:
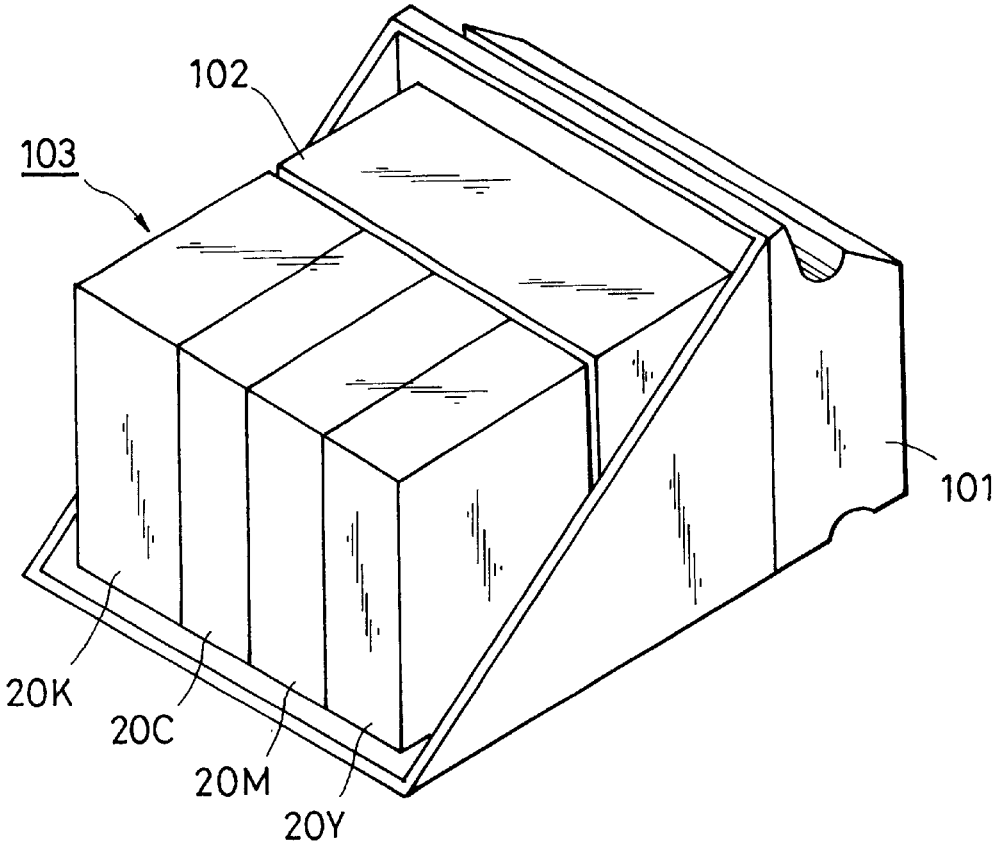
FIG. 16 is a schematic perspective view of a recording head unit.
Figure 17:
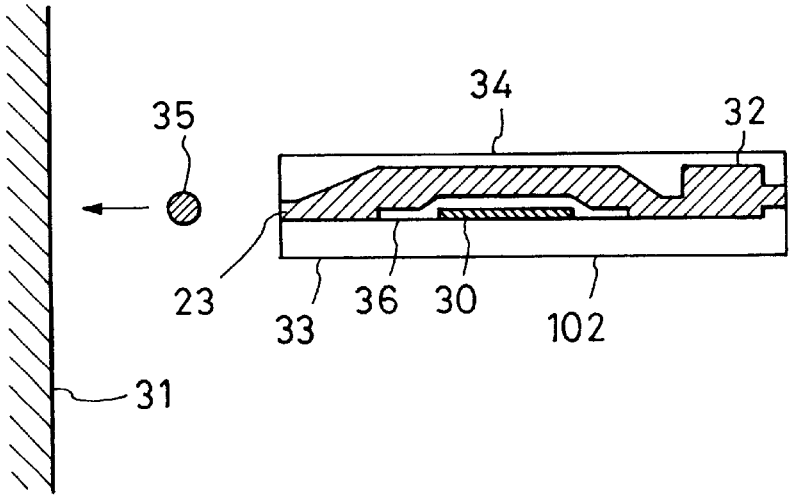
FIG. 17 is a schematic enlarged sectional view of a heat generating member and thereabout in a recording head.
Figure 18:
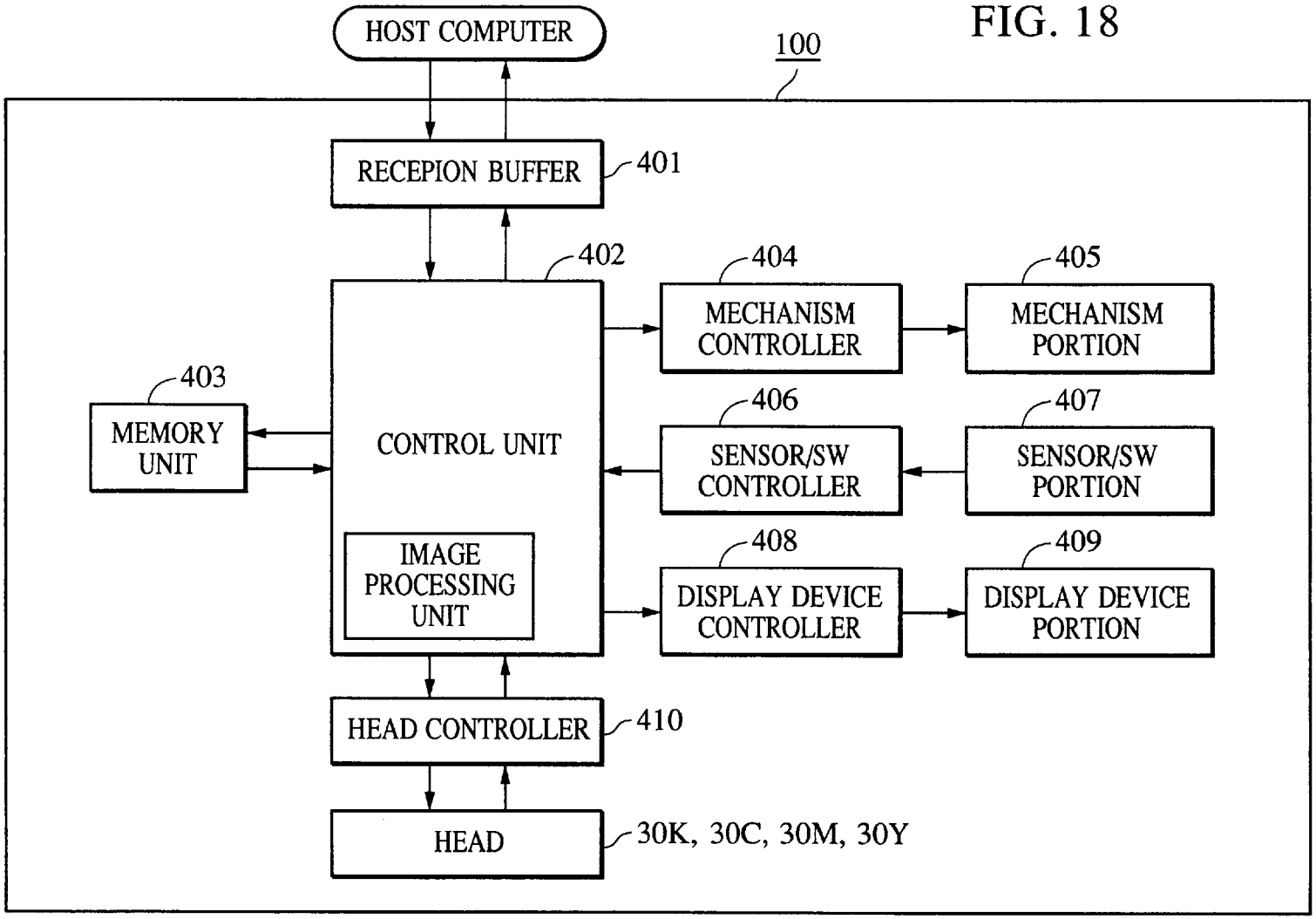
FIG. 18 is a block diagram for driving the recording head in the ink jet recording apparatus stated above.

A fifth embodiment will be described below with reference to a control block diagram of FIG. 13. In FIG. 13, steps of detecting the head temperature and detecting the environment temperature are the same as those in the above embodiments and hence are not described here. In this fifth embodiment, in parallel to detection of the head temperature and the environment temperature, a printing duty D (=actual printing dots number/total data number in the printing area) of the next scan is detected from print data for the next scan that is developed on a print buffer of the printing controller 9. If the head temperature rises to meet $Th > T0$, then the printing duty D of the next scan is compared with a printing duty threshold Dth by referring to a conversion table of the environment temperature Tr versus the printing duty threshold Dth as shown in FIG. 14. If the printing duty D is larger than a threshold Dn defined corresponding to an environment temperature Trn at that time, then the printing mode is changed to split printing so that the printing duty is held below Dn. The term "split printing" used herein means a method restricting the number of used nozzles to reduce the printing duty as with the above third embodiment, or a method of completing an image by scanning the carriage several times over the same printing area while using all the nozzles, thereby reducing the actual printing duty per scan (irrespective of whether recording paper is fed or not until the image of the printing area is completed).

The printing process executed in this embodiment will now be explained in more detail. In the above third embodiment, the number of used nozzles is restricted without depending on the amount of print data to be printed by the next scan. This process, however, may overly restrict the printing duty (the number of used nozzles) even in the case where the printing duty is low, i.e., the amount of print data is small, and the head temperature does not so rise in fact. This embodiment uses a conversion table in which the printing duty threshold Dth is defined with respect to the environment temperature Tr in the relationships of $Tr1 < Tr2 < \ldots < Trn < \ldots$ and $D1 > D2 > \ldots > Dn > \ldots$, as shown in FIG. 14. Here, Dn is set as a printing duty threshold corresponding to the amount of temperature rise allowed to perform the printing at the environment temperature Tr. The printing duty D is compared with Dn and the split print is set based on a result of the comparison so that the printing duty in actual scan is always kept not larger than Dn, but not much smaller than Dn. This eliminates reduction in printing speed that is caused in the second embodiment when the printing duty in much smaller than Dn. As a result, the printing can be continued at the stable and proper print speed at all times.

While a manner of calculating the printing duty D is not explained above in detail, the printing duty D may be calculated in the printer body, or the host computer may be given a function of calculating the printing duty D.

Also, the printing duty D may be calculated by counting the actual printing dot number for all data successively, or by dividing the printing area into plural blocks vertically, horizontally or in both directions, counting the actual printing dot number for each of the blocks, and then summing up the counted numbers for all the blocks. Additionally, the number of nozzles used in the actual printing may be controlled for each of blocks defined by dividing the printing area for other particular purposes. The present invention is not essentially affected by such a modification and hence not limited to the embodiment explained above.

Further, this fifth embodiment can also be practiced in control based on $\Delta T$ rather than only the environment temperature Tr by using a table of $\Delta T$ versus the printing duty threshold Dth in step S135 instead of the table of the environment temperature Tr versus the printing duty threshold Dth.

According to the present invention, as described hereinabove, an excessive temperature rise of the ink jet head is prevented; hence failure of ink ejection and damage of the head can be avoided. In addition, since a standby time, extra split printing and so on which have been hitherto incorporated in the control process more than required are eliminated, the efficiency of recording is improved and higher-speed recording can be achieved as a whole.

What is claimed is:

1. A control method for an ink jet recording apparatus with which an amount of heat generated by an ink jet head is restricted when a condition of a head temperature being not lower than a predetermined threshold is determined by the use of means for detecting the head temperature and an environment temperature around said ink jet head, comprising the steps of:

measuring a temperature of the ink jet head;

detecting an environment temperature around the ink jet head; and changing an extent of restricting the amount of heat generated by said ink jet head depending on the detected environment temperature or a difference between the ink jet head temperature and the environment temperature.

2. A control method for an ink jet recording apparatus according to claim 1, wherein the extent of said restriction is changed by varying an extent-of-restriction determining parameter depending on the environment temperature or the difference between the head temperature and the environment temperature.

3. A control method for an ink jet recording apparatus according to claim 2, wherein said extent-of-restriction determining parameter is selected from a table in which the extent of said restriction is defined with respect to the environment temperature or the difference between the head temperature and the environment temperature.

4. A control method for an ink jet recording apparatus according to claim 1, wherein the amount of heat generated by said head is restricted by at least one of an interrupt of printing for a predetermined time, a thinned-out printing, a restriction of the maximum number of usable nozzles in said head, and an interrupt of printing until the head temperature is lowered down below a predetermined temperature.

5. A control method for an ink jet recording apparatus according to claim 2, wherein said extent-of-restriction determining parameter is an interrupt time during which printing is interrupted for a predetermined time to restrict the amount of heat generated by said head.

6. A control method for an ink jet recording apparatus according to claim 2, wherein said extent-of-restriction determining parameter is a thinning-out rate at which thinned-out printing is performed to restrict the amount of heat generated by said head.

7. A control method for an ink jet recording apparatus according to claim 2, wherein said extent-of-restriction determining parameter is the maximum number of usable nozzles to which the number of used nozzles in said head is limited to restrict the, amount of heat generated by said head.

8. A control method for an ink jet recording apparatus according to claim 2, wherein said extent-of-restriction determining parameter is a predetermined temperature below which the head temperature is lowered down by interrupting printing to restrict the amount of heat generated by said head.

9. A control method for an ink jet recording apparatus according to claim 1, wherein the heat generated by said head produces a bubble in ink based on a film boiling phenomenon, and an ink droplet is ejected from an ejection port under pressure developed upon said bubble being produced.

10. An ink jet recording apparatus comprising:

means for detecting a temperature of an ink jet head, means for detecting an environment temperature around said head, means for restricting an amount of heat generated by said head when a condition of the head temperature being not lower than a predetermined threshold is determined, and control means for changing an extent of restricting the amount of heat generated by said head depending on the environment temperature or a difference between the head temperature and the environment temperature.

11. An ink jet recording apparatus according to claim 10, wherein said control means changes the extent of said restriction by varying an extent-of-restriction determining parameter depending on the environment temperature or the difference between the head temperature and the environment temperature.

12. An ink jet recording apparatus according to claim 11, wherein said control means includes a table in which the extent of said restriction is defined with respect to the environment temperature or the difference between the head temperature and the environment temperature.

13. An ink jet recording apparatus according to claim 10, wherein the amount of heat generated by said head is restricted by at least one of an interrupt of printing for a predetermined time, a thinned-out printing, a restriction of the maximum number of usable nozzles in said head, and an interrupt of printing until the head temperature is lowered down below a predetermined temperature.

14. An ink jet recording apparatus according to claim 11, wherein said extent-of-restriction determining parameter is an interrupt time during which printing is interrupted for a predetermined time to restrict the amount of heat generated by said head.

15. An ink jet recording apparatus according to claim 11, wherein said extent-of-restriction determining parameter is a thinning-out rate at which thinned-out printing is performed to restrict the amount of heat generated by said head.

16. An ink jet recording apparatus according to claim 11, wherein said extent-of-restriction determining parameter is the maximum number of usable nozzles to which the number of used nozzles in said head is limited to restrict the amount of heat generated by said head.

17. An ink jet recording apparatus according to claim 11, wherein said extent-of-restriction determining parameter is a predetermined temperature below which the head temperature is lowered down by interrupting printing to restrict the amount of heat generated by said head.

18. An ink jet recording apparatus according to claim 11, wherein the heat generated by said head produces a bubble in ink based on a film boiling phenomenon, and an ink droplet is ejected from an ejection port under pressure developed upon said bubble being produced.

19. A control method for an ink jet recording apparatus with which an amount of heat generated by an ink jet head is restricted when a condition of a head temperature being not lower than a predetermined threshold is determined by the use of means for detecting the head temperature and an environment temperature around said head, comprising the steps of:

detecting the environment temperature around the ink jet head; and changing an extent of restricting the amount of heat generated by said head depending on the environment temperature.

20. A control method for an ink jet recording apparatus according to claim 19, wherein the extent of said restriction is changed by varying an extent-of-restriction determining parameter depending on the environment temperature or the difference between the head temperature and the environment temperature.

21. A control method for an ink jet recording apparatus according to claim 20, wherein said extent-of-restriction determining parameter is selected from a table in which the extent of said restriction is defined with respect to the environment temperature or the difference between the head temperature and the environment temperature.

22. A control method for an ink jet recording apparatus according to claim 19, wherein the amount of heat generated by said head is restricted by at least one of an interrupt of printing for a predetermined time, a thinned-out printing, a restriction of the maximum number of usable nozzles in said head, and an interrupt of printing until the head temperature is lowered down below a predetermined temperature.

23. A control method for an ink jet recording apparatus according to claim 20, wherein said extent-of-restriction determining parameter is an interrupt time during which printing is interrupted for a predetermined time to restrict the amount of heat generated by said head.

24. A control method for an ink jet recording apparatus according to claim 20, wherein said extent-of-restriction determining parameter is a thinning-out rate at which thinned-out printing is performed to restrict the amount of heat generated by said head.

25. A control method for an ink jet recording apparatus according to claim 20, wherein said extent-of-restriction determining parameter is the maximum number of usable nozzles to which the number of used nozzles in said head is limited to restrict the amount of heat generated by said head.

26. A control method for an ink jet recording apparatus according to claim 20, wherein said extent-of-restriction determining parameter is a predetermined temperature below which the head temperature is lowered down by interrupting printing to restrict the amount of heat generated by said head.

27. A control method for an ink jet recording apparatus according to claim 19, wherein the heat generated by said head produces a bubble in ink based on a film boiling phenomenon, and an ink droplet is ejected from an ejection port under pressure developed upon said bubble being produced.

28. An ink jet recording apparatus comprising:

means for detecting an environment temperature around an ink jet head, means for restricting an amount of heat generated by said ink jet head when a condition of the ink jet head temperature being not lower than a predetermined threshold is determined, and control means for changing an extent of restricting the amount of heat generated by said ink jet head depending on the environment temperature.

29. An ink jet recording apparatus according to claim 28, wherein said control means changes the extent of said restriction by varying an extent-of-restriction determining parameter depending on the environment temperature or the difference between the head temperature and the environment temperature.

30. An ink jet recording apparatus according to claim 29, wherein said control means includes a table in which the extent of said restriction is defined with respect to the environment temperature or the difference between the head temperature and the environment temperature.

31. An ink jet recording apparatus according to claim 28, wherein the amount of heat generated by said head is restricted by at least one of an interrupt of printing for a predetermined time, a thinned-out printing, a restriction of the maximum number of usable nozzles in said head, and an interrupt of printing until the head temperature is lowered down below a predetermined temperature.

32. An ink jet recording apparatus according to claim 29, wherein said extent-of-restriction determining parameter is an interrupt time during which printing is interrupted for a predetermined time to restrict the amount of heat generated by said head.

33. An ink jet recording apparatus according to claim 29, wherein said extent-of-restriction determining parameter is a thinning-out rate at which thinned-out printing is performed to restrict the amount of heat generated by said head.

34. An ink jet recording apparatus according to claim 29, wherein said extent-of-restriction determining parameter is the maximum number of usable nozzles to which the number of used nozzles in said head is limited to restrict the amount of heat generated by said head.

35. An ink jet recording apparatus according to claim 29, wherein said extent-of-restriction determining parameter is a predetermined temperature below which the head temperature is lowered down by interrupting printing to restrict the amount of heat generated by said head.

36. An ink jet recording apparatus according to claim 29, wherein the heat generated by said head produces a bubble in ink based on a film boiling phenomenon, and an ink droplet is ejected from an ejection port under pressure developed upon said bubble being produced.

* * * * *

UNITED STATES PATENT AND TRADEMARK OFFICE

CERTIFICATE OF CORRECTION

PATENT NO. : 6,406,113 B1
DATED : June 18, 2002
INVENTOR(S) : Masao Kato

It is certified that error appears in the above-identified patent and that said Letters Patent is hereby corrected as shown below:

Column 2,
Line 15, “schema tic” should read -- schematic --; and “he at” should read -- heat --;
Line 20, “an,ink” should read -- an ink --;
Line 21, “gene rating” should read -- generating --; and
Line 24, “drive n” should read -- driven --.

Column 3,
Line 24, “rasing” should read -- raising --.

Column 10,
Line 6, “higher.” should read -- higher --.

Column 11,
Line 14, “and” should be deleted.

Column 12,
Line 16, “in” should read -- is --.

Column 13,
Line 30, “the,” should read -- the --.

Signed and Sealed this

Eleventh Day of February, 2003

JAMES E. ROGAN
*Director of the United States Patent and Trademark Office*